United States Patent [19]

Le Mer

[11] 4,288,136

[45] Sep. 8, 1981

[54] METAL CUPBOARD

[76] Inventor: Gérard Le Mer, 12 Chemin du Milieu, 95540 Mery sur Oise, France

[21] Appl. No.: 68,649

[22] Filed: Aug. 22, 1979

[30] Foreign Application Priority Data

Sep. 5, 1978 [FR] France ..... 78 25474

[51] Int. Cl.[3] ..... A47B 43/00; E06B 9/14

[52] U.S. Cl. ..... 312/297; 312/257 R; 312/257 SK; 312/108; 220/84

[58] Field of Search ..... 312/297, 257 SK, 257 SM, 312/257 A, 257 R, 108, 111, 322, 100; 220/84

[56] References Cited

U.S. PATENT DOCUMENTS

| | | | |
|---|---|---|---|
| 2,104,939 | 1/1938 | Whalen | 312/322 |
| 2,206,347 | 7/1940 | Derman | 312/297 |
| 2,527,226 | 10/1950 | Levine | 312/257 A |
| 2,669,499 | 2/1954 | Vanderplank | 312/322 |
| 2,710,784 | 6/1955 | Morin | 312/257 SK |
| 2,991,140 | 7/1961 | Anderson et al. | 312/257 SK |
| 3,034,844 | 5/1962 | Anderson et al. | 312/257 SK |
| 3,087,768 | 4/1963 | Anderson et al. | 312/257 SK |
| 3,456,995 | 7/1969 | Nyquist | 312/322 |
| 3,623,784 | 11/1971 | Neufeld | 312/257 SM |
| 4,077,686 | 3/1978 | Bukaitz | 312/257 SK |

FOREIGN PATENT DOCUMENTS

| | | |
|---|---|---|
| 774150 | 10/1971 | Belgium . |
| 1150069 | 1/1958 | France . |
| 1441080 | 4/1966 | France . |
| 1562134 | 2/1969 | France . |

*Primary Examiner*—Victor N. Sakran
*Attorney, Agent, or Firm*—Irons and Sears

[57] ABSTRACT

The cupboard is made from a framework comprising four tubular uprights having a square section and two rectangular or square frames. The sides of the frames are tubes having the same square section as the uprights. In the corners of each frame, the adjacent tubular members are assembled by means of oblique welded gussets. The latter permit the assembly with the uprights engaged in recesses of the frames by means of screws. The side panels are locked to the framework by a roof-cover which has folded edge portions which overlap the upper end of the panels.

4 Claims, 3 Drawing Figures

METAL CUPBOARD

DESCRIPTION

The present invention relates to a metal cupboard comprising a parallel-sided framework at least two opposed lateral sides of which are closed by rectangular panels, the framework comprising four uprights constituted by tubular section members which are assembled at their respective ends with two rectangular- or square-shaped frames constituted by tubular members.

The object of the invention is to provide such a cupboard which is particularly simple in construction and permits a rapid and easy assembly enabling the cupboard to be erected around an existing structure which must be protected, such as for example a column having rotary drums for the storage of files.

The invention provides a cupboard wherein each of the opposed panels comprises at its lower end a flange engaged on the corresponding tubular member of the lower frame, whereas its upper end comprises a cranked portion which forms a flange disposed on the corresponding tubular member of the upper frame which is covered by a roof constituted by a metal sheet whose edge portions are folded at a right angle so as to form a cover the edge portions of which overlap the upper end of the panels and locks them to ensure their assembly.

The simplicity of the assembly resides in the fact that, after construction of the framework, the cladding panels and the door are placed in position merely by fitting or jointing operations with no need for any tool so that unqualified persons may easily carry out the assembly. Moreover, the very structure of the framework, and in particular the use of a lower frame in fact reduced to a closed contour defining a completely free inner space, enables the cupboard to be constructed, for example, around a filing column having rotary drums without necessity to withdraw any file from the drums or to dismantle the latter.

According to another feature of the invention, in each frame, the adjacent tubular members defining a corner of the frame are in adjoining relation along a common edge so as to define on the outside a recess which is adapted to fit the section of the corresponding upright and they are assembled by means of a welded gusset constituting a plate which is obliquely oriented and through which there may be inserted a screw which is oriented diagonally and screwed into a corresponding tapped aperture of the associated upright so as to assemble the latter with the frame.

The assembly of the framework itself, which only requires a simple screw-driver, is also easy. This assembly can be still further simplified if, in accordance with a modification of the invention, the frames comprise at each of their corners, rigid end members which are oriented to be perpendicular to the plane of the frame and may be fitted in the inner opening of the tubular uprights.

The invention will be described in a purely illustrative manner in the ensuing description, with reference to the accompanying drawings in which.

Figure 1:
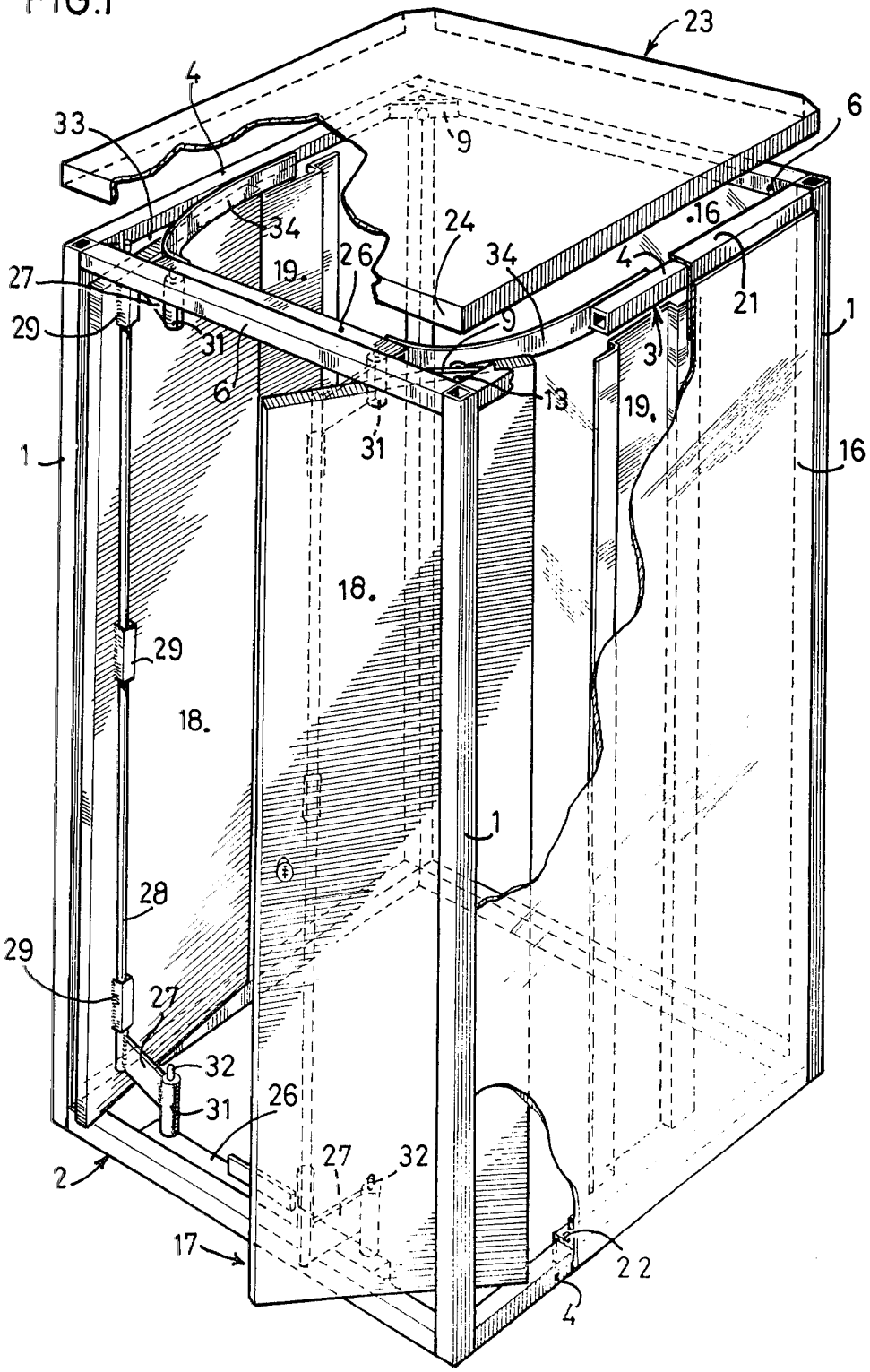
FIG. 1 is a perspective view, with a part cut away, of a metal cupboard according to the invention.

The illustrated metal cupboard is constructed from a framework comprising four square-section tubular uprights 1 and two frames, 2, 3 which are rectangular or square in shape and have sides 4,4–6,6 which are tubes having the same square section as the uprights 1. In each frame 2, 3 the tubular members 4, 6 defining a corner of the frame are in adjoining relation along a common edge 7 so as to define on the outside a recess 8 having a right angle and fitting one half of the tubular section of the corresponding upright 1 and they are assembled by means of a gusset 9 which forms an obliquely disposed plate whose edges are welded to the respective tubular members. Provided in the plate 9 and in the zone of the members 4, 6 which is adjacent to the common edge 7, are coinciding apertures 11, 12 through which there extends a screw 13 which is diagonally oriented and screwed into a corresponding tapped aperture 14 of the upright 1 so as to rigidly assemble the latter with the frame.

The cladding of the framework for making up the cupboard is achieved by means of three vertical panels 16, which cover three vertical sides of the framework, and a door structure 17 having two door elements 18 which are mounted in such manner as to be capable of closing the fourth side.

Each vertical panel 16 has a generally rectangular shape and is of sheet metal and may be stiffened by a reinforcing omega-section reinforcement 19 welded to the inner face of the panel. The vertical edge portions of the panel are bent at a right angle at 16*a* and are in contact with the corresponding sides of the uprights 1. The upper end of the panel has a horizontal flange 21 which is placed on the corresponding side 4 of the upper frame 3, whereas a Z-shaped section member 22 which forms a flange fitted around the corresponding side 4 of the lower frame 2 is welded to the inside of the lower end of the panel. The three panels 16 are held in position and locked by a roof 23 constituted by a metal sheet whose edge portions 24 are folded at a right angle so that the roof constitutes a lid which caps the upper end portions of the panels which bear against the frame 3.

In the case where the cupboard must be provided with shelves, there are employed for the uprights 1 tubes having perforations which are equally spaced apart and permit the mounting of hooks and the adjustment of the shelves in height.

Figure 2:
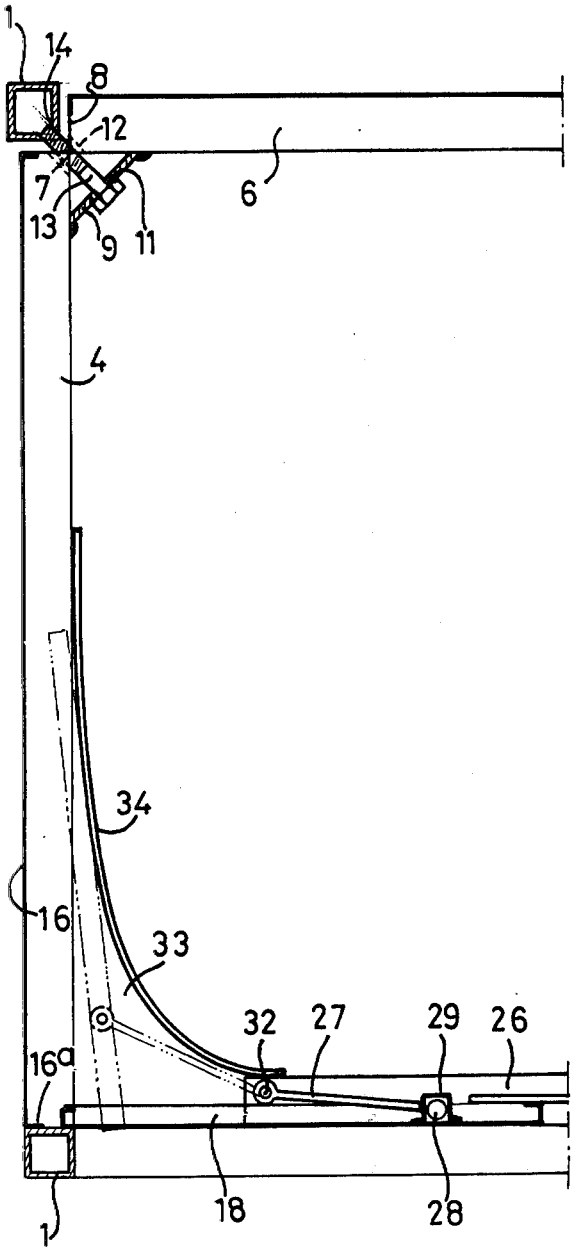
FIG. 2 is a partial top plan view of the cupboard with the cover removed.

In the illustrated embodiment, the cupboard is arranged to contain a filing column having rotary drums so that there are no shelves and, in order to facilitate access to the drums carrying the files, each door element 18 is adapted to enter the interior of the cupboard alongside the lateral panels 16 in the open position of the door structure. For this purpose, at each of its upper and lower ends, each door element 18 is pivotally mounted on a square tube 26, which is welded to the tubular member 6 of the corresponding frame, by means of a link 27 having one end welded to a spindle 28 which is rotatively mounted in U-shaped sleeves 29 welded to the rear side of the upright 18, the other end of the link being provided with a cylindrical sleeve 31 in which is inserted a pivot pin 32 engaged in the corresponding tube 26. For convenience of assembly, the upper pivot pin 32 is permanently fixed in the associated sleeve 31 and the lower pivot pin 32 is removable. In the course of its inward movement corresponding to the opening of the door structure, each door element 18 is guided in the upper part of the framework in a passageway 33 which is defined by the adjacent panel 16 and by a curved guide rail 34 which approaches the panel 16 in the direction from the wide entrance of the passageway while leaving sufficient place for the sliding of the door element. The movement of the latter to the final position shown in FIG. 3 is clearly shown in FIG. 2.

Figure 3:
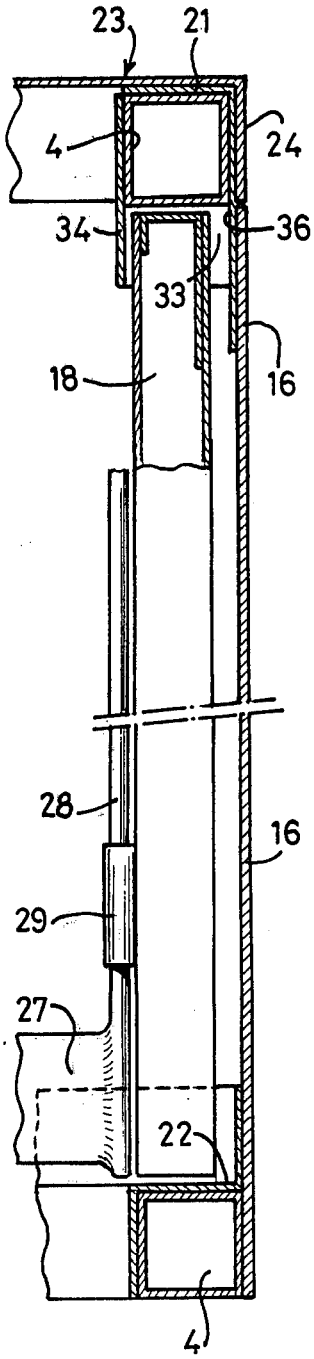
FIG. 3 is a partial vertical sectional view of one side of the cupboard showing a door element in its pushed-back position.

FIG. 3 also shows that in order to ensure that the folded edge portion 24 of the cover 23 does not project from the outer face of the panel 16, the bearing flange 21 of this panel is formed by a horizontal flange of an L-section member 36 whose vertical flange is welded to the inner face of the panel 16.

Having now described my invention what I claim as new and desire to secure by Letters Patent is:

1. In a metal cupboard comprising a parallel-sided framework, the framework comprising an upper frame having a rectangular shape and comprising tubular members, a lower frame having a rectangular shape and comprising tubular members, four uprights constituted by tubular section members which are assembled at respective ends thereof with the upper and lower frames, at least two rectangular panels respectively closing at least two lateral sides of the framework, which sides are in opposed relation, and a sheet metal roof covering said upper frame; the improvement comprising an arrangement which is sufficient to maintain said at least two panels assembled with the framework and with the roof and comprises in combination first flange means rigid with a lower end portion of each of said at least two panels and downwardly bearing on a corresponding one of said tubular members of said lower frame, second flange means rigid with an upper end portion of each of said at least two panels and downwardly bearing on a corresponding one of said tubular members of said upper frame, and downwardly extending edge portions on said roof so that said roof constitutes a lid which closely caps said at least two panels and said downwardly extending edge portions overlap and engage said upper end portions of said at least two panels and trap said upper end portions between said downwardly extending edge portions and said corresponding ones of said tubular members of said upper frame and said roof overlaps and engages said second flange means and traps said second flange means between said roof and said corresponding ones of said tubular members of said upper frame.

2. A cupboard as claimed in claim 1, wherein the tubular section members of the framework and the tubular members of the frames have a square-crosssectional shape and said second flange means is a flange which is at right angle with the corresponding panel and is disposed flat against the corresponding tubular member of said upper frame and flat against the roof.

3. A cupboard as claim in claim 1 or 2, comprising means defining a door opening between said two lateral sides of the framework, two displaceable side-by-side door elements respectively having edges forming a joint line intermediate said two lateral sides of the framework when the door elements are in a closing position in a plane, each door element being pivotally mounted on the framework at an upper and a lower end thereof by means comprising a link which is pivotally connected to the door element adjacent a first end of the link and pivotally connected to the cupboard adjacent a second end opposed to said first end of the link, said pivotal connections having pivot axes parallel to said plane, the link being pivotable outwardly of the cupboard when initiating a displacement of the corresponding door element from said closed position thereof for opening said door opening, said first end of the link being adjacent said edge of the corresponding door element and said second end of the link being remote from said edge in a closing position of the door elements, means being provided for guiding each door element and comprising a rail which is mounted on the framework and extends inwardly of the cupboard from said door opening and defines with a corresponding one of said at least two panels an inwardly tapering passageway for receiving an edge of the door element remote from said edge thereof when opening the door opening, the rail and links constraining the door element to move back into the interior of the cupboard alongside the corresponding panel.

4. A cupboard as claimed in claim 1 or 2, wherein the second flange means of each of said at least two panels is constituted by a horizontal flange of an L-section member which has a vertical flange which is welded to an inner face of the panel and is inwardly offset relative to the panel and constitutes said upper edge portion of the panel and defines a recess receiving the downwardly extending edge portions of the roof.

* * * * *